US006024277A

United States Patent [19]

Martin

[11] Patent Number: 6,024,277

[45] Date of Patent: Feb. 15, 2000

[54] MAGNETIC POCKET DISPLAY CARD

[75] Inventor: John J. Martin, Louisville, Ky.

[73] Assignee: Crane Productions, Inc., Louisville, Ky.

[21] Appl. No.: 09/167,290

[22] Filed: Oct. 6, 1998

Related U.S. Application Data

[63] Continuation-in-part of application No. 08/982,621, Dec. 2, 1997, Pat. No. 5,924,624, which is a continuation-in-part of application No. 08/905,037, Aug. 1, 1997, Pat. No. 5,868,498, which is a continuation of application No. 08/484,990, Jun. 7, 1995, abandoned.

[51] Int. Cl.[7] ..... B65D 27/04

[52] U.S. Cl. ..... 229/71; 40/711; 229/92.8

[58] Field of Search ..... 229/71, 92.3, 92.7, 229/92.8, 301, 303; 40/711, 774, 775, 776

[56] References Cited

U.S. PATENT DOCUMENTS

| | | | |
|---|---|---|---|
| 4,244,511 | 1/1981 | Coleman | 229/92.3 |
| 5,261,174 | 11/1993 | Blegen | 40/152 |
| 5,303,489 | 4/1994 | Blegen | 40/152 |
| 5,458,282 | 10/1995 | Martin | 229/92.8 |
| 5,676,307 | 10/1997 | Martin | 229/92.8 |
| 5,868,498 | 2/1999 | Martin | 40/600 |
| 5,918,400 | 7/1999 | Schonberger | 40/711 |
| 5,924,624 | 7/1999 | Martin | 229/71 |

*Primary Examiner*—Stephen P. Garbe
*Attorney, Agent, or Firm*—James C. Eaves, Jr.; Greenbaum Doll & McDonald PLLC

[57] ABSTRACT

A pocket card, including a planar blank having first and second planar surfaces, and first and second fold lines dividing the planar blank into a back wall portion, a protective flap and a pocket-forming flap. The protective flap is foldable over the back wall portion to define a pocket therebetween. The protective flap is foldable over the folded pocket-forming flap to provide a mailable enclosure. An opening is provided in the back wall portion of the planar blank and a magnet is positioned over the magnet such that the magnet is contained within the mailable enclosure. The pocket card is affixable from a magnetic surface, such as a refrigerator, office desk, filing cabinet or the like, to expose the pocket and a plurality of inserts held therein.

20 Claims, 7 Drawing Sheets

MAGNETIC POCKET DISPLAY CARD

CROSS-REFERENCE TO RELATED APPLICATIONS

This application is a continuation-in-part ("CIP") of, and claims priority from, my pending U.S. utility patent application Ser. No. 08/982,621 entitled "Magnetic Pocket Frame" filed on Dec. 2, 1997, now U.S. Pat. No. 5,924,624, said '621 application being incorporated herein by reference, and being a CIP of, and claiming priority from, my U.S. utility patent application Ser. No. 08/905,037 entitled "Magnetic Pocket Card" filed on Aug. 1, 1997, now U.S. Pat. No. 5,868,498, said '037 application being incorporated herein by reference, and being a continuation of, and claiming priority from, my U.S. utility patent application Ser. No. 08/484,990 entitled "Magnetic Pocket Card" filed on Jun. 7, 1995, now abandoned, said '990 application being incorporated herein by reference.

BACKGROUND OF THE INVENTION

1. Technical Field of the Invention

The present invention relates to pocket cards for receiving and holding inserts therein. More particularly, the present invention relates to a pocket card for receiving and holding an insert therein, wherein the pocket card is provided with means for removably attaching the pocket card to a surface.

2. Description of the Related Art

It is oftentimes desirable to provide a foldable pocket card for receiving inserts therein, such as, for example, to mail letters, cards, certificates, coupons, photographs or the like. For example, U.S. Pat. No. 4,044,942 to Sherwood teaches a multiple mailing folder adaptable to mail such inserts, and U.S. Pat. No. 5,156,274 to Williams, Jr., et al., teaches an emergency breakdown assistance kit including a polyethylene envelope having a plurality of signs provided therein for viewing therethrough. It is therefore desirable to provide a pocket card for receiving and holding inserts therein, wherein the pocket card is suitable for mailing.

It is further desirable to provide a pocket card for receiving inserts therein, wherein the pocket card is provided with means for removably attaching the pocket card to a surface, such as, for example, a refrigerator, office desk, filing cabinet or the like, to display the pocket card and inserts therefrom.

It is further desirable to provide a pocket card for receiving inserts therein, wherein the pocket card is provided with means for removably attaching the pocket card to a surface, such as, for example, a refrigerator, office desk, filing cabinet or the like, and wherein the inserts are removable from the pocket when the pocket card is attached to the surface.

It is even further desirable to provide a pocket card for receiving inserts therein, wherein the pocket card is provided with means for removably attaching the pocket card to a surface, such as, for example, a refrigerator, office desk, filing cabinet or the like, and wherein the inserts are displayable through a window provided in the pocket card.

It is also desirable to provide a pocket card for receiving inserts therein, wherein the pocket card is provided with means for removably attaching the pocket card to a surface, such as, for example, a refrigerator, office desk, filing cabinet or the like, and wherein the means for removably attaching the pocket card to the surface is removable from the pocket card.

SUMMARY OF THE INVENTION

The present invention is for a pocket card having a planar blank defining a pocket for receiving at least one insert therein, such as, for example, a letter, card, certificate, coupon, photograph or the like. The planar blank includes a plurality of flaps being foldable to define an insert-receiving pocket and a protective flap foldable thereover suitable for mailing the at least one insert therein. The protective flap may be removed from the pocket card to expose the pocket and to provide access thereto for removal of the at least one insert therefrom.

A back wall of the pocket card is provided with an opening therethrough and covered with a thin film of plastic. A magnet is adhesively secured to the thin film of plastic, over the opening, such that the pocket card may be removably attached to a magnetic surface, such as, for example, a refrigerator, office desk, filing cabinet or the like, with the pocket facing away from the magnetic surface, and being accessible thereby. The pocket card is reusable to provide a removably attachable coupon organizer for viewing and storing any insert of the type hereinabove described, whether or not such insert was originally mailed in the pocket card.

It is an object of the present invention to provide a pocket card for receiving and holding inserts therein, wherein the pocket card is suitable for mailing.

It is another object of the present invention to provide a pocket card for receiving inserts therein, wherein the pocket card is provided with means for removably attaching the pocket card to a surface, such as, for example, a refrigerator, office desk, filing cabinet or the like, to display the pocket card and inserts therefrom.

It is still another object of the present invention to provide a pocket card for receiving inserts therein, wherein the pocket card is provided with means for removably attaching the pocket card to a surface, such as, for example, a refrigerator, office desk, filing cabinet or the like, and wherein the inserts are removable from the pocket when the pocket card is attached to the surface.

It is yet another object of the present invention to provide a pocket card for receiving inserts therein, wherein the pocket card is provided with means for removably attaching the pocket card to a surface, such as, for example, a refrigerator, office desk, filing cabinet or the like, and wherein the inserts are displayable through a window provided in the pocket card.

It is an even further object of the present invention to provide a pocket card for receiving inserts therein, wherein the pocket card is provided with means for removably attaching the pocket card to a surface, such as, for example, a refrigerator, office desk, filing cabinet or the like, and wherein the means for removably attaching the pocket card to the surface is removable from the pocket card.

These and other objects, features and advantages of the present invention will become apparent to those skilled in the art upon reading the ensuing detailed description in conjunction with the drawings and with reference to the appended claims.

A pocket card according to a preferred embodiment of the present invention includes a planar blank having first and second planar surfaces, and first and second fold lines, the first and second fold lines dividing the planar blank into a back wall portion, a protective flap adjacent the back wall portion along the first fold line, and a pocket-forming flap adjacent the back wall portion along the second fold line. An opening is provided in the back wall portion of the planar blank and a magnet is affixed to the first planar surface of the back wall portion over the opening. The pocket-forming flap is foldable about the second fold line over the back wall portion and is secured thereto at at least one preselected location thereon, thereby forming a pocket between the back wall portion and the pocket-forming flap. The protective flap is foldable about the first fold line over the pocket-forming flap and is secured thereto at at least one preselected location thereon to enclose the magnet within the pocket card.

BRIEF DESCRIPTION OF THE DRAWINGS

A better understanding of the present invention will be had upon reference to the following description in conjunction with the accompanying drawings in which like numerals refer to like parts, and wherein.

DETAILED DESCRIPTION OF THE PREFERRED EMBODIMENTS

Figure 1:
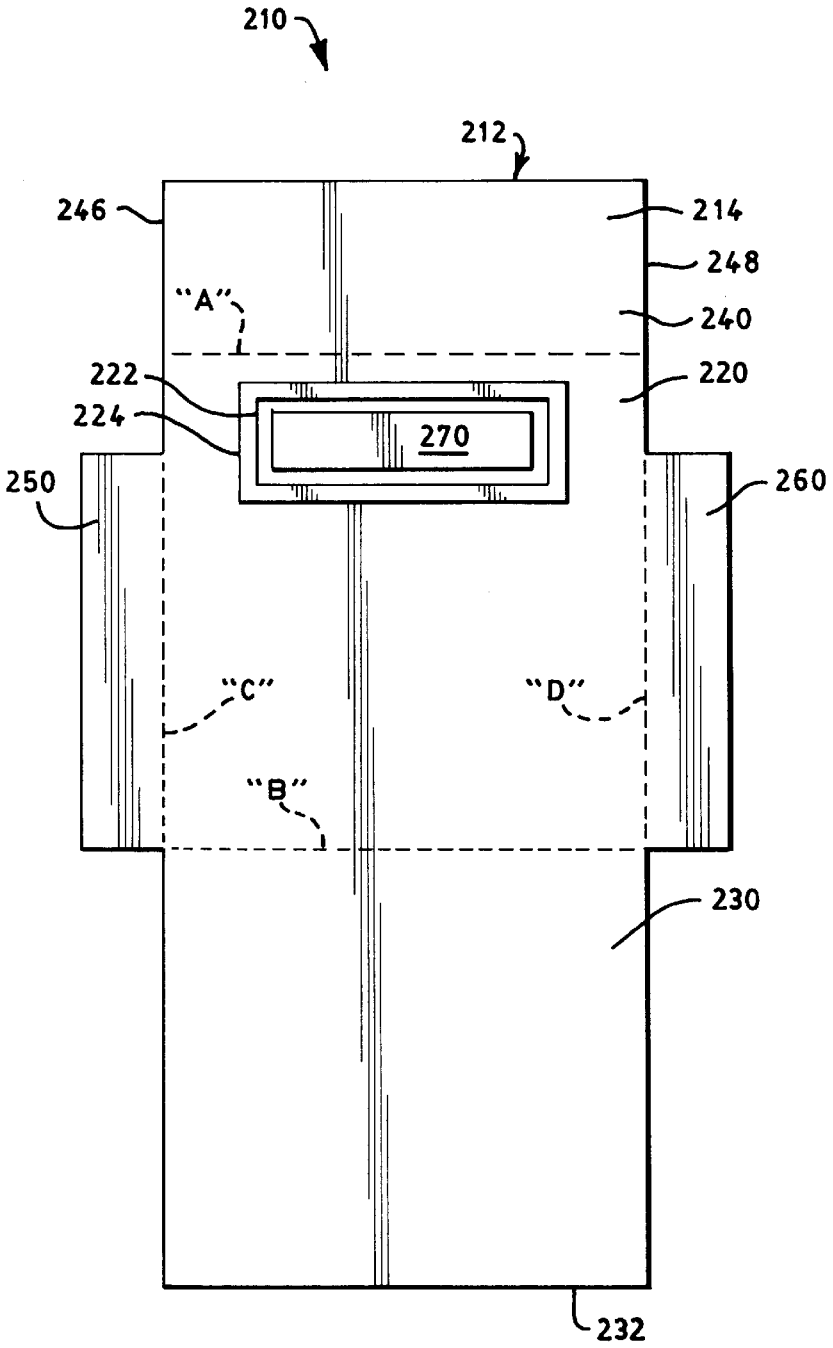
FIG. 1 is a front view of a planar blank being foldable to define a pocket card according to a preferred embodiment of the present invention.
Figure 2:
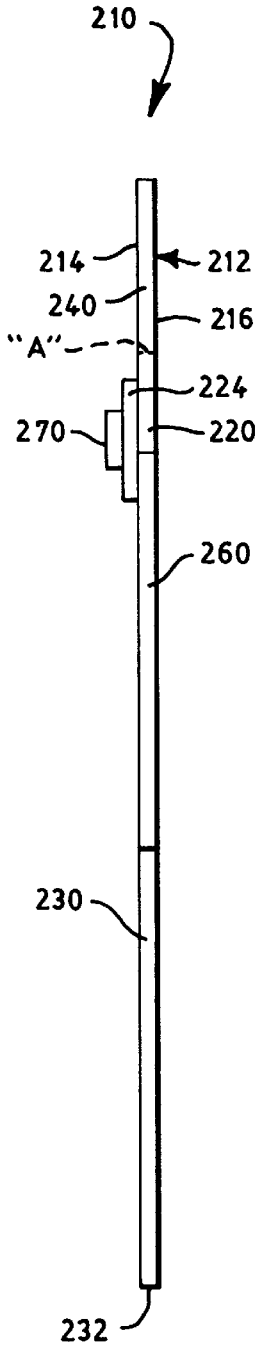
FIG. 2 is a side view of the planar blank of FIG. 1.

With reference to FIGS. 1 and 2, a pocket card 210 according to a preferred embodiment of the present invention includes a planar blank 212 having a first planar surface 214 and a second planar surface 216. The planar blank 212 is divided by fold lines "A" and "B" into a back wall portion 220, a pocket-forming flap 230 being upwardly foldable about fold line "B" over the first planar surface 214 of the back wall portion 220, and a protective flap 240 being downwardly foldable about fold line "A" over the first planar surface 214 of the back wall portion 220, and over the second planar surface 216 of the pocket-forming flap 230. Fold line "A" is preferably a perforation line, or the like.

An opening 222 is provided through the back wall portion 220 near the fold line "A" and is covered on one side thereon with a thin, flexible transparent film 224, such as, for example, polyethylene. The film 224 is adhesively secured to the first planar surface 214 of the back wall portion 220 immediately outward of the opening 222. The opening 222 may be of any size which is sufficient to permit a thin, flexible sheet of magnetic material 270 to be adhesively secured to a front side of the film 224, wherein the magnetic sheet 270 is sufficiently large to magnetically secure the pocket card 210 to a magnetic surface, such as, for example, a refrigerator, office desk, filing cabinet or the like. The thin sheet of flexible magnetic material 270 is known and is preferable a vinyl material including magnetic materials dispersed therethrough. Such a sheet of flexible magnetic material can be commercially purchased under the trademark "UltraMag" from Flex-Mag Industrial, Inc., a division of Dynacast Co., Marietta, Ohio. The magnetic material 270 may alternatively be adhesively affixed directly to the first planar surface 214 of the back wall portion 220, wherein the film 224 is not provided.

Side flaps 250, 260, form an integral construction with the back wall portion 220 of the planar blank 212 and project transversely outwardly therefrom. The side flaps 250, 260 are coplanar with the planar blank 212 and are foldable thereover about fold lines "C" and "D", respectively. Fold lines "C", "D" are substantially transverse to fold lines "A", "B" and are substantially collinear with first and second side edges 246, 248, respectively, of the protective flap 240.

Figure 3:
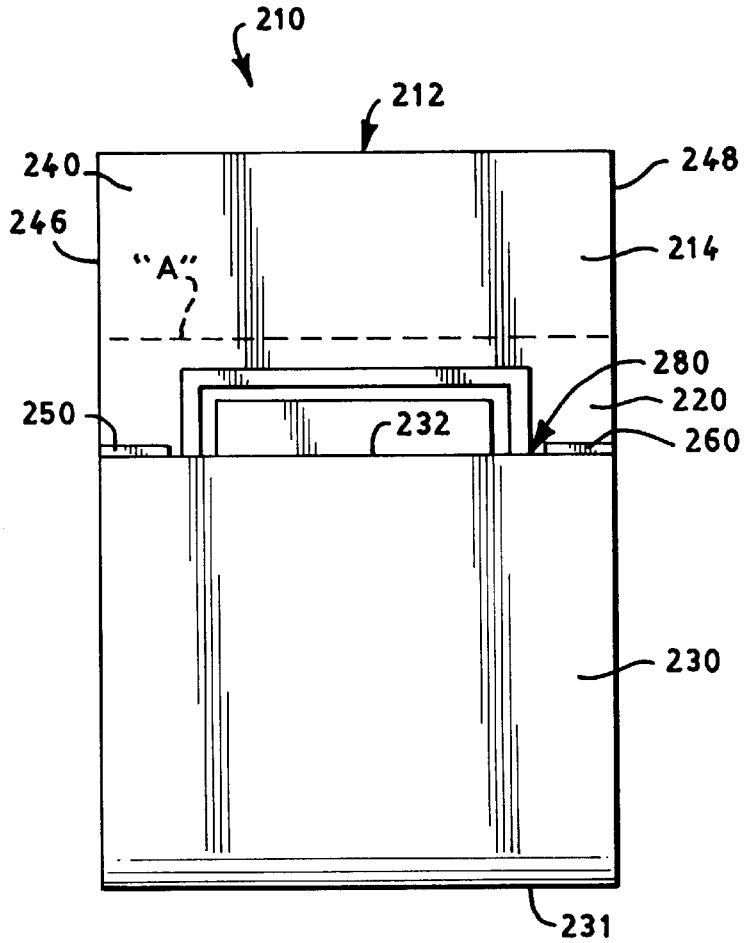
FIG. 3 is a front view of the pocket card being defined by the planar blank of FIG. 1.
Figure 4:
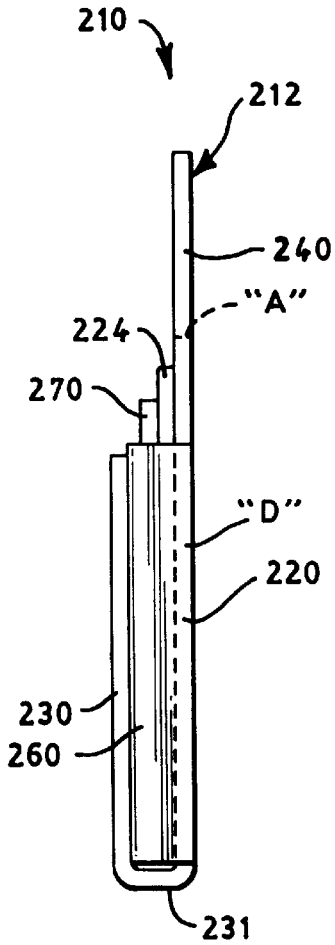
FIG. 4 is a side view of the pocket card of FIG. 3.

With reference to FIGS. 3 and 4, the planar blank 212 is foldable into the pocket card 210 about fold lines "B", "C" and "D" to form a pocket 280 defined by the back wall portion 220, the first and second side flaps 250, 260, respectively, and the pocket-forming flap 230. The pocket 280 is sized to receive at least one insert (FIG. 6) therein, such as, for example, a letter, card, certificate, coupon, photograph or the like. More particularly, the pocket 280 is formed by folding the first and second side flaps 250, 260, respectively, inwardly about fold lines "C", "D", respectively, and over the first planar surface 214 of the back wall portion 220. The pocket-forming flap 230 is folded upwardly about the fold line "B", over the first planar surface 214 of the back wall portion 220, and over each respective second planar surface 216 of the inwardly-folded side flaps 250, 260, to which the first planar surface 214 of the pocket-forming flap 230 is adhesively secured thereto at at least one location thereon. Alternatively, instead of side flaps 250, 260, an adhesive may be used along the sides of the back wall portion 220 to attach the pocket-forming flap 230 directly to the back wall portion 220.

Figure 5:
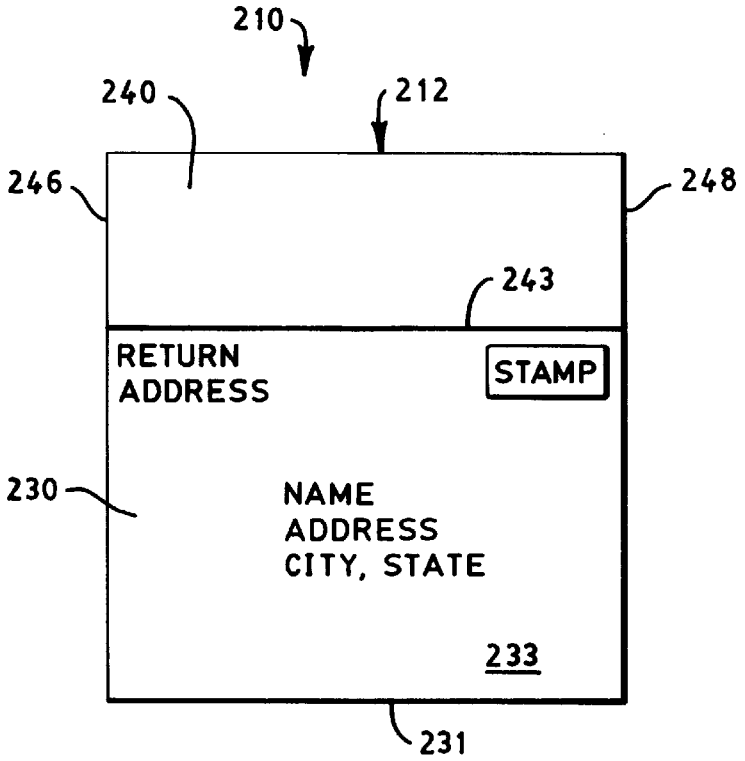
FIG. 5 is a front view of the pocket card of FIG. 3 being folded for mailing and shown prior to removal of a protective flap provided thereby.
Figure 6:
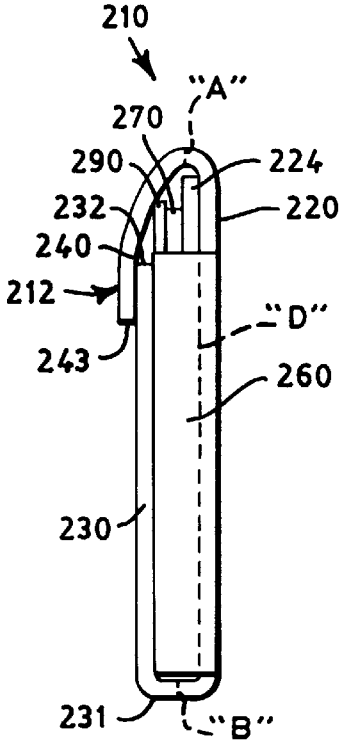
FIG. 6 is a side view of the pocket card of FIG. 5.
Figure 7:
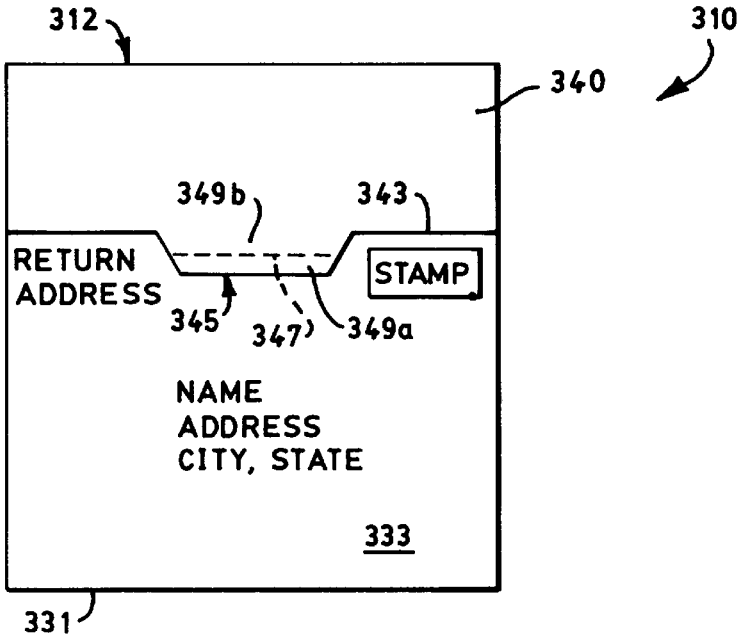
FIG. 7 is a front view of the pocket card of FIG. 3, being folded for mailing and showing an alternative protective flap portion.
Figure 8:
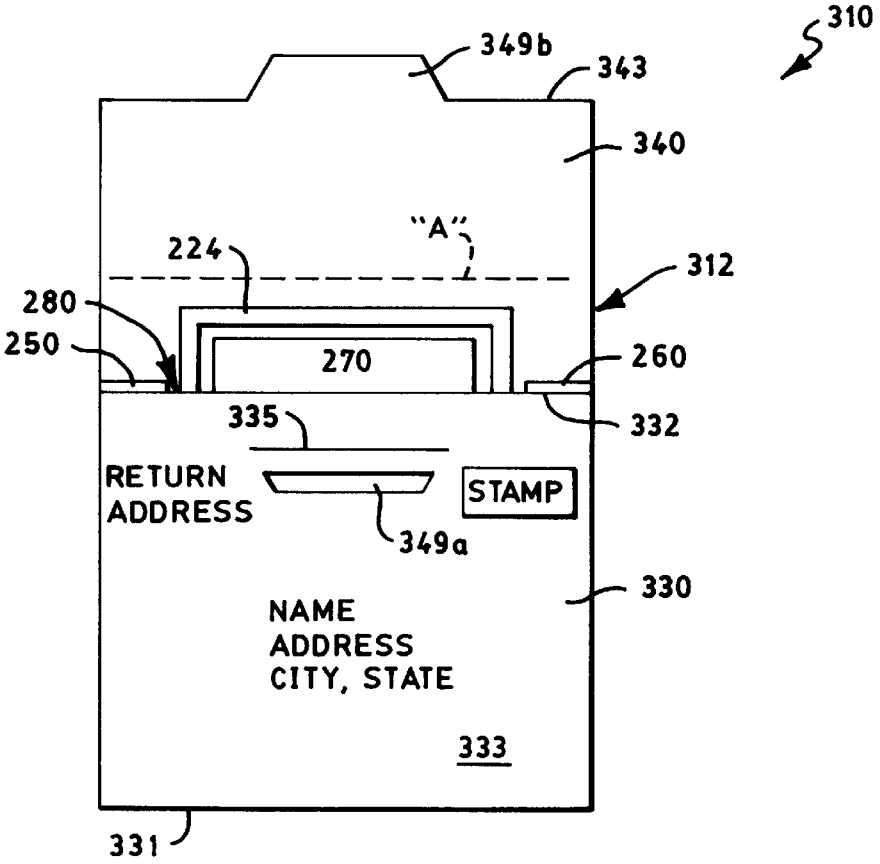
FIG. 8 is a front view of the pocket card of FIG. 7, showing the protective flap in an open position.

With additional reference to FIGS. 5 and 6, the pocket card 210 is folded into an orientation suitable for mailing as a first-class mail item with the U.S. Postal Service. More particularly, the protective flap 240 is foldable downwardly over the first planar surface 214 of the back wall portion 220 and over the second planar surface 216 of the upwardly-folded pocket-forming flap 230, thereby enclosing the at least on insert 290 and the sheet of magnetic material 280 therein.

The first planar surface 214 of the protective flap 240 is adhesively secured to the second planar surface 216 of the pocket-forming flap 230, by a line of adhesive, preferably ½" wide, extending transversely thereacross from the first side edge 246 of the protective flap 240 to the second side edge 248 of the protective flap 240. The line of adhesive is disposed between outermost ends 232, 243 of the pocket-forming flap 230 and the protective flap 240, respectively. Alternatively, the line of adhesive need not extend continuously between the first and second side edges 246, 248 of the protective 240, but may extend only over a portion thereof.

The protective flap 240 is sized to completely cover the flexible sheet of magnetic material 270 and a portion of the second planar surface 216 of the pocket-forming flap 230 between the outermost end 243 of the protective flap 240 and a pocket end 231 of the pocket-forming flap 230, the pocket end 231 of the pocket-forming flap 230 being defined by the fold line "B".

The lower portion 233 of the second planar surface 216 of the pocket-forming flap 230 can be printed with indicia indicating the location of a postage stamp, location of addressee information, and location of return-address information. Alternatively, a label providing such indicia or such information may be adhesively affixed directly on the lower portion 233. Alternatively yet, the lower portion 233 may be provided with an address window (not shown), wherein a frontmost insert 290 may contain such indicia or such information printed thereon which is viewable through the window when the insert is positioned within the pocket 280. The lower portion 233 may also be provided with advertising or other decorative indicia, graphics or artwork, wherein mailing information may then be provided on the second planar surface 216 of the back wall portion 220.

To expose the pocket 280, such as, for example, when an individual wishes to gain access to the at least one insert 290 therein, the individual grasps one side edge 246, 248 of the protective flap 240 and pulls the protective flap 240 upwardly away from the pocket-forming flap 230 to which the protective flap 240 has been adhesively secured as hereinabove described. The protective flap 240 is thereby detached from the pocket-forming flap 230 and may be removed from the pocket card 210 altogether, for example, when fold line "A" is a perforation line. Once the protective flap 240 has been detached from the pocket-forming flap 230, the pocket 280, the at least one insert 290 held therein and the flexible sheet of magnetic material 270 are each exposed to the individual.

Either prior to, or after, detachment of the protective flap 240 from the pocket-forming flap 230, the pocket card 210 may be magnetically secured to a magnetic surface, for example, a refrigerator, office desk, filing cabinet or the like, to provide a convenient means to hold the at least one insert 90 therein until needed. More particularly, the pocket card 210 is oriented relative to the magnetic surface such that the second planar surface 216 of the back-wall portion 220 is in immediate abutting relationship with the magnetic surface and such that the pocket 280 faces outwardly therefrom to permit removal of the at least one insert 290 therefrom without requiring that the pocket card 210 be removed from the magnetic surface beforehand.

The magnetic attractive force inherent in the flexible sheet of magnetic material 270, having only the thin transparent film 2243 between it and the magnetic surface, readily secures the pocket card 210 to the magnetic surface without slippage therebetween. However, the flexible sheet of magnetic material 270, the opening 222 and the transparent film 224 are each sized to permit the pocket card 210 to support various sized inserts therein from the magnetic surface and to permit easy removal therefrom. The first planar surface 214 of the pocket-forming flap 230 may be provided with advertisements or other information, such as business phone numbers, addresses or the like, to be used in conjunction with the inserts 290.

The sheet of magnetic material 270 may be removed from the transparent film 224, such as, for example, when each of the at least one insert 290 has been removed from the pocket 280 and the individual no longer wishes to use the pocket card 210 as described herein. One surface of the sheet of magnetic material 270 may have advertisements of other information, such as, for example, business phone numbers, addresses or the like, to provide a lasting advertising means to be used separately from the pocket card 210, once the pocket card 210 is no longer needed or has been discarded.

With reference 7 and 8, a pocket card 310 according to an alternative embodiment of the present invention includes many components in common with the pocket card 210 according to the preferred embodiment hereof and like reference numerals are intended to represent like components. However, a pocket card 310 according to the present embodiment includes a planar blank 312 having a protective flap 340 with a tab 345 projecting from an outermost end 343 of the protective flap 340. The tab 345 includes a perforation line 347 thereacross, dividing the tab 345 into an outermost hold-down portion 349*a*nd a retaining portion 349*b*.

The hold-down portion 349*a* of the protective flap 340 is adhesively secured to the second planar surface 216 of the pocket -forming flap 330 for mailing of the inserts therein as herein described. To open the pocket card 330, the user tears the tab 345, along the perforation line 347, thereby separating the retaining portion 349*b* of the tab 345 from the hold-down portion 349*a* of the tab 340, which remains affixed to the pocket-forming flap 330. The protective flap 340 is thereby separated from the pocket-forming flap 330 and may be unfolded along fold line "A" to expose the pocket 280 and the inserts 290 therein.

A slit 335 may be provided between the outermost end 332 of the pocket-forming flap 330 and the hold-down portion 349*a* of the protective flap tab 345, which remains affixed thereto. The slit 335 is sized to receive the retaining portion 349*b* of the protective flap tab 345 therein so that the pocket card 310 may be re-closed after a first opening thereof.

Figure 9:
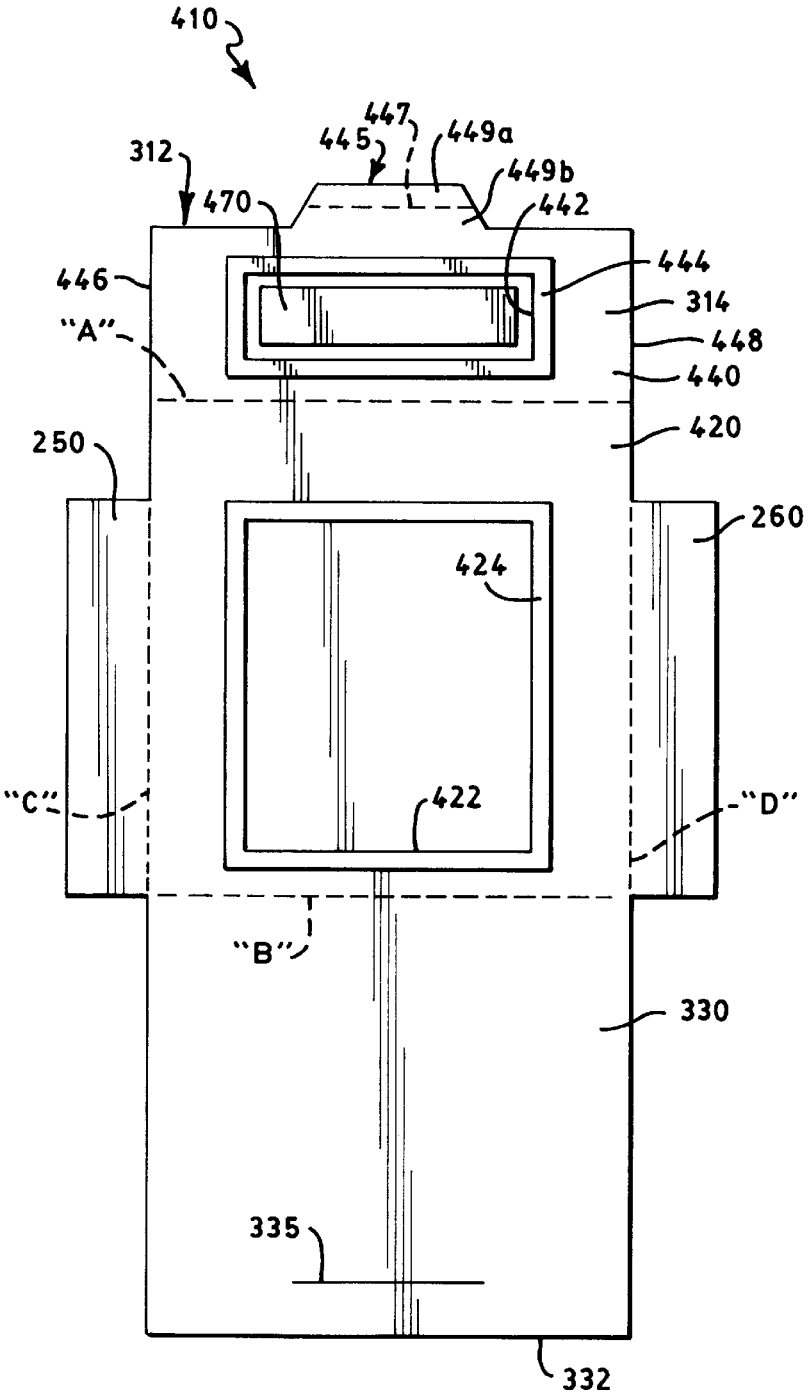
FIG. 9 is a front view of a planar blank being foldable to define a pocket card according to another alternative embodiment of the present invention.
Figure 10:
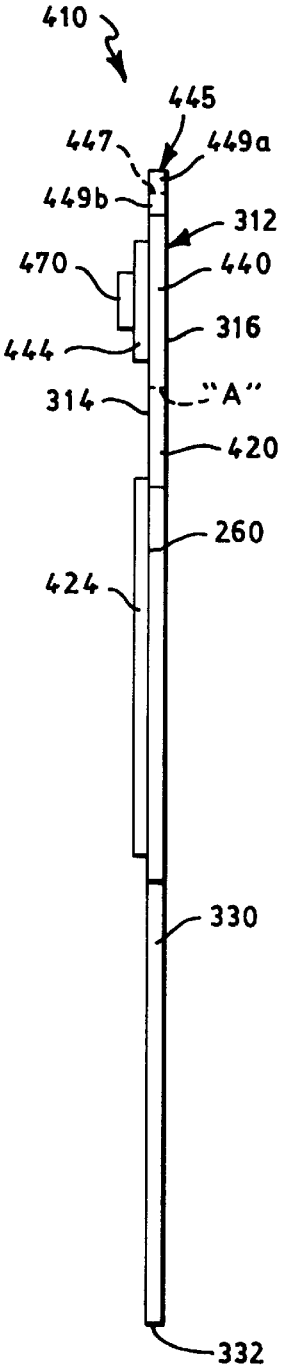
FIG. 10 is a side view of the planar blank of FIG. 9.
Figure 11:
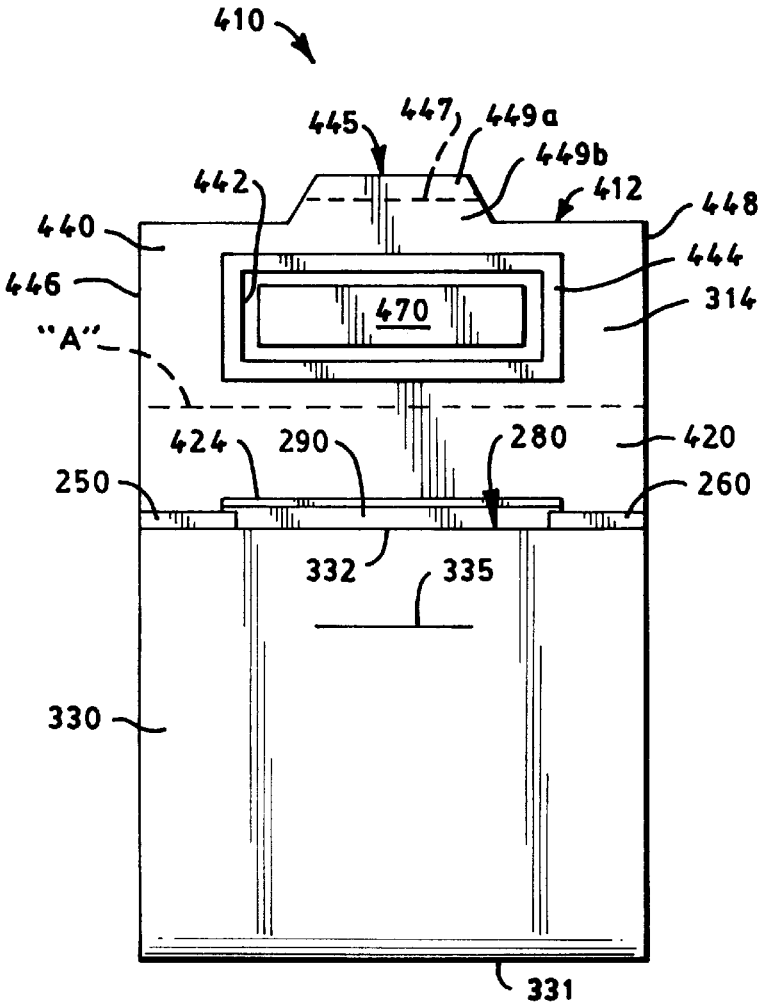
FIG. 11 is a front view of the pocket card being defined by the planar blank of FIG. 9.

With reference to FIGS. 9 and 10, a pocket card 410 according to another alternative embodiment of the present invention includes many components in common with the pocket card 210 according to the preferred embodiment hereof and like reference numerals are intended to represent like components. However, the pocket card 410 according to the present embodiment includes a planar blank 312 having protective flap 440 with an opening 442 therethrough near fold line "A". The opening 442 is covered on one side thereof with a thin, flexible transparent film 444, such as, for example, polyethylene, which is adhesively secured to the first planar surface 314 of the protective flap 440 immediately outward of the opening 442. The opening 442 may be of any size which is sufficient to permit a thin, flexible sheet of magnetic material 470 to be adhesively secured to a front surface of the film 444, wherein the magnetic sheet 470 is sufficiently large to magnetically secure the pocket card 410 to a magnetic surface, such as, for example, a refrigerator, office desk, filing cabinet or the like. Alternatively, the thin sheet of magnetic material 470 may be adhesively secured directly to the first planar surface 314 of the protective flap 440, over the opening 442, wherein the film 444 is not provided.

Figure 12:
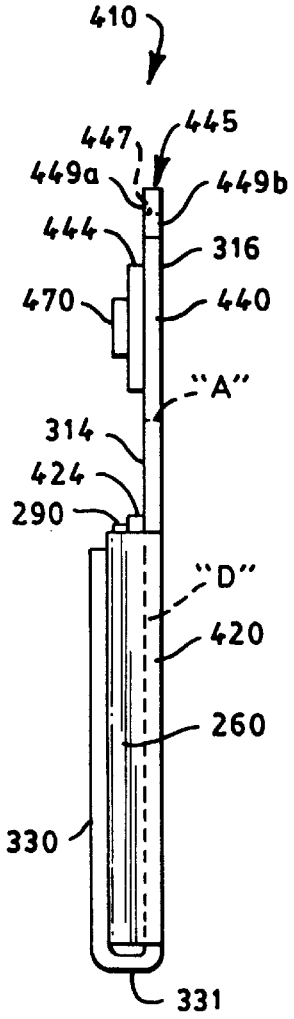
FIG. 12 is a side view of the pocket card of FIG. 11.
Figure 13:
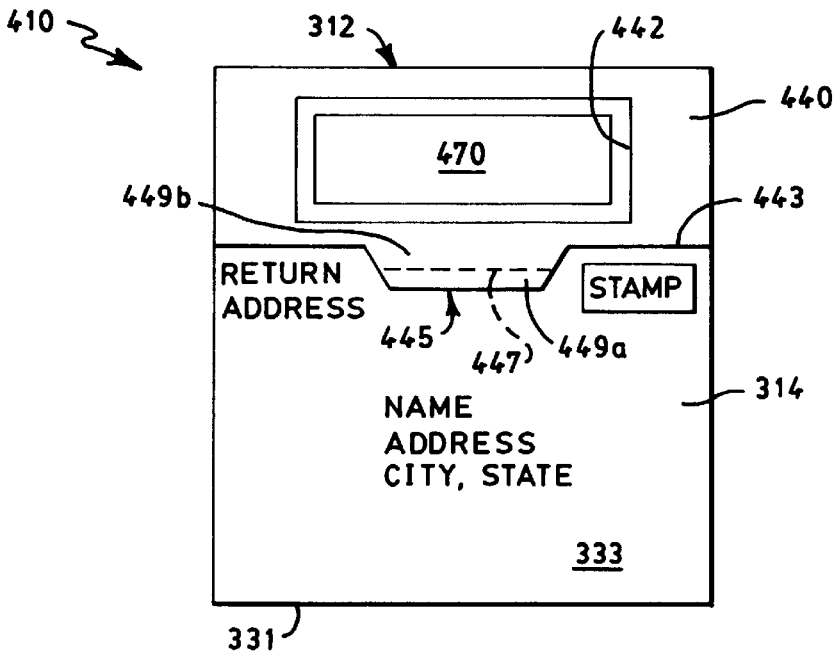
FIG. 13 is a front view of the pocket card of FIG. 11 being folded for mailing and shown prior to opening a protective flap provided thereby; and, FIG. 14 is a front view of the pocket card of FIG. 13, showing the protective flap in an open position.
Figure 14:
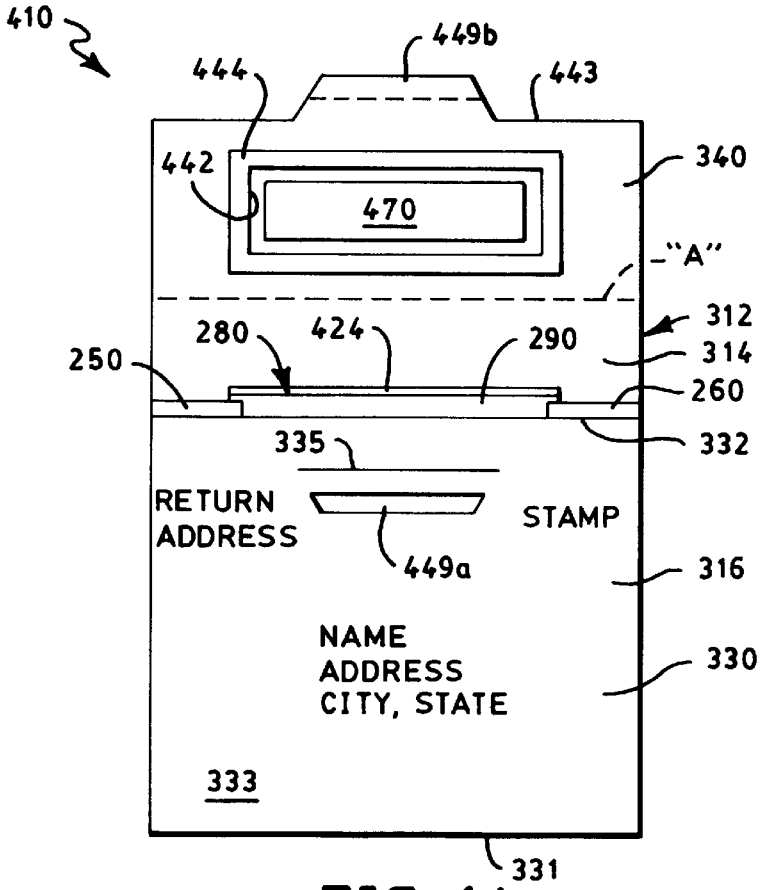

The back wall portion 420 of the planar blank 312 includes a window 422 therethrough spaced between first and second fold lines "A", "B", respectively, and covered on one side thereof with a thin, flexible transparent film 424, such as, for example, polyethylene. The film 424 is adhesively secured to the first planar surface 314 of the back wall portion 420 outward of the window 422, which permits viewing of the plurality of inserts 290 (FIG. 12) through the back wall portion 420.

With additional reference to FIGS. 11–14, folding of the pocket card 410 according to the present embodiment into a orientation suitable for mailing is as described hereinabove with respect to the preferred embodiment hereof. However, the pocket card 410 according to the present embodiment is magnetically affixable to a magnetic surface, such as, for example, a refrigerator, office desk, filing cabinet or the like, while in the folded, mailable orientation, such that the second planar surface 316 of the protective flap 440 is in immediate abutting relationship with the magnetic surface, and such that the second planar surface 316 of the back wall portion 430 faces away from the magnetic surface and is viewable by an individual standing before the magnetic surface. The magnetic attractive force inherent in the flexible sheet of magnetic material 470, having only the thin transparent film 442 between it and the magnetic surface, readily secures the pocket card 410 to the magnetic surface without slippage therebetween.

The window 422 of the back wall portion 420, then, permits viewing of the rearmost insert 290 positioned within the pocket 280. The second planar surface 316 of the back wall portion 430 may be provided with graphics, artwork or other decorative effects around the window 422 to give an ornamental appearance thereto, for example, that of a picture frame or the like.

The protective flap 440 includes a tab 445 projecting from an outermost end 443 of the protective flap 440 spaced between first and second side edges 446, 448, respectively, of the protective flap 440. The tab 445 includes a perforation line 447 thereacross, dividing the tab 445 into an outermost hold-down portion 449*a* and a retaining portion 449*b*.

The hold-down portion 449*a* of the protective flap 440 is adhesively secured to the second planar surface 316 of the pocket-forming flap 430 for mailing of the inserts therein as described herein. To open the pocket card 410, the user tears the tab 445, along the perforation line 447, thereby separating the retaining portion 449*b* of the tab 445 from the hold-down portion 449*a* of the tab 440, which remains affixed to the pocket-forming flap 330. The protective flap 440 is thereby separated from the pocket-forming flap 330 and may be unfolded along fold line "A" to expose the pocket 280 and the inserts 290 therein.

A slit 335 is provided between the outermost end 332 of the pocket-forming flap 330 and the hold-down portion 449*a* of the protective flap tab 445, which remains affixed thereto. The slit 335 is sized to receive the retaining portion 449*b* of the protective flap tab 445 therein so that the pocket card 410 may be re-closed after a first opening thereof and re-affixed to the magnetic surface as described hereinabove. After the inserts 290 have been removed from the pocket card 410, the individual may replace the inserts 290 with other items, such as photographs, certificates or the like, which the individual wishes to display from the pocket card 410 through the window 422 of the back wall portion 420.

Although the present invention has been described in terms of specific embodiments which are set forth in detail, it should be understood that this is by illustration only and that the present invention is not necessarily limited thereto, since alternative embodiments not described in detail herein will become apparent to those skilled in the art in view of the disclosure. Accordingly, modifications are contemplated which can be made without departing from either the spirit or the scope of the present invention as described hereinabove.

I claim:

1. A pocket card, comprising:

a planar blank having first and second planar surfaces, and first and second fold lines dividing said planar blank into a back wall portion, a protective flap adjacent said back wall portion along said first fold line, and a pocket-forming flap adjacent said back wall portion along said second fold line;

an opening in said planar blank;

a magnet positioned over said opening;

said pocket-forming flap being folded about said second fold line over said back wall portion and being secured thereto at at least one preselected location thereon, thereby forming a pocket between said back wall portion and said pocket-forming flap; and, said protective flap being folded about said first fold line over said pocket-forming flap and being secured thereto at at least one preselected location thereon.

2. The pocket card according to claim 1, wherein said opening is provided in said back wall portion of said planar blank.

3. The pocket card according to claim 1, wherein said magnet is removably affixed to said planar blank.

4. The pocket card according to claim 1, wherein said opening is provided in said protective flap of said planar blank.

5. The pocket card according to claim 4, further comprising:

a window provided in said back wall portion of said planar blank.

6. The pocket card according to claim 5, further comprising:

a film affixed to said planar blank over said window.

7. The pocket card according to claim 1, said protective flap having a tab projecting therefrom, said tab being affixable to said pocket-forming flap.

8. The pocket card according to claim 7, said tab having a tear line thereacross, said tear line dividing said tab into a hold-down portion and a retaining portion, said hold-down portion being affixable to said pocket-forming flap.

9. The pocket card according to claim 8, said pocket-forming flap having a slit therein for receiving said retaining portion of said tab.

10. The pocket card according to claim 1, said protective flap being removable from said planar blank.

11. A pocket card, comprising:

a planar blank having first and second planar surfaces, and first and second fold lines dividing said planar blank into a back wall portion, a protective flap adjacent said back wall portion along said first fold line, and a pocket-forming flap adjacent said back wall portion along said second fold line;

an opening in said planar blank;

a film affixed to said planar blank over said opening;

a magnet affixed to said film;

said pocket-forming flap being folded about said second fold line over said back wall portion and being secured thereto at at least one preselected location thereon, thereby forming a pocket between said back wall portion and said pocket-forming flap; and, said protective flap being folded about said first fold line over said pocket-forming flap and being secured thereto at at least one preselected location thereon.

12. The pocket card according to claim 11, wherein said opening is provided in said back wall portion of said planar blank.

13. The pocket card according to claim 11, wherein said magnet is removably affixed to said planar blank.

14. The pocket card according to claim 11, wherein said opening is provided in said protective flap of said planar blank.

15. The pocket card according to claim 14, further comprising:

a window provided in said back wall portion of said planar blank.

16. The pocket card according to claim 15, further comprising:

a film affixed to said planar blank over said window.

17. The pocket card according to claim 11, said protective flap having a tab projecting therefrom, said tab being affixable to said pocket-forming flap.

18. The pocket card according to claim 17, said tab having a tear line thereacross, said tear line dividing said tab into a hold-down portion and a retaining portion, said hold-down portion being affixable to said pocket-forming flap.

19. The pocket card according to claim 18, said pocket-forming flap having a slit therein for receiving said retaining portion of said tab.

20. The pocket card according to claim 11, said protective flap being removable from said planar blank.

* * * * *